US008513146B2

(12) United States Patent
Hietpas et al.

(10) Patent No.: US 8,513,146 B2
(45) Date of Patent: Aug. 20, 2013

(54) SCALLOPED OVAL BICOMPONENT FIBERS WITH GOOD WICKING, AND HIGH UNIFORMITY SPUN YARNS COMPRISING SUCH FIBERS

(75) Inventors: Geoffrey David Hietpas, Newark, DE (US); David A. Price, Sr., Smyrna, DE (US); Steven Wayne Smith, Waynesboro, VA (US)

(73) Assignee: Invista North America S.ár.l., Wilmington, DE (US)

( * ) Notice: Subject to any disclaimer, the term of this patent is extended or adjusted under 35 U.S.C. 154(b) by 1334 days.

(21) Appl. No.: 11/238,468

(22) Filed: Sep. 29, 2005

(65) Prior Publication Data

US 2007/0071974 A1 Mar. 29, 2007

(51) Int. Cl.
*D02G 3/22* (2006.01)

(52) U.S. Cl.
USPC ..... 442/196; 442/337; 428/370; 428/373; 428/374

(58) Field of Classification Search
USPC ..... 428/370, 373–374; 442/196, 337
See application file for complete search history.

(56) References Cited

U.S. PATENT DOCUMENTS

| | | | |
|---|---|---|---|
| 3,454,460 | A | 7/1969 | Bosley |
| 3,536,763 | A | 10/1970 | Eleuterio et al. |
| 3,671,379 | A | 6/1972 | Evans et al. |
| 3,914,488 | A | 10/1975 | Gorrafa |
| 4,156,071 | A | 5/1979 | Knox |
| 4,634,625 | A | 1/1987 | Franklin |
| 5,102,724 | A | 4/1992 | Okawahara et al. |
| 5,219,506 | A | 6/1993 | Anderson et al. |
| 5,591,523 | A | 1/1997 | Aneja |
| 5,626,961 | A | 5/1997 | Aneja |
| 5,723,215 | A | 3/1998 | Hernandez et al. |
| 5,736,243 | A | 4/1998 | Aneja |
| 5,817,740 | A | 10/1998 | Anderson et al. |
| 5,834,119 | A | 11/1998 | Roop |
| 5,874,372 | A | 2/1999 | Morishita et al. |
| 6,013,368 | A | 1/2000 | Aneja |

(Continued)

FOREIGN PATENT DOCUMENTS

| | | |
|---|---|---|
| EP | 0604973 A1 | 7/1994 |
| JP | 1962-085026 | 4/1987 |

(Continued)

OTHER PUBLICATIONS

International Search Report to PCT/US02/41124.

(Continued)

*Primary Examiner* — Elizabeth Cole
(74) *Attorney, Agent, or Firm* — Christina W. Geerlof

(57) ABSTRACT

The invention provides a polyester bicomponent staple fiber comprising poly(trimethylene terephthalate) and at least one polymer selected from the group consisting of poly(ethylene terephthalate), poly(trimethylene terephthalate), and poly (tetramethylene terephthalate) or a combination of such members, said bicomponent staple fiber having:

a) a scalloped oval cross-section shape having an aspect ratio a:b of about 2:1 to about 5:1 wherein 'a' is a fiber cross-section major axis length and 'b' is a fiber cross-section minor axis length;
b) a polymer interface substantially perpendicular to the major axis;
c) a cross-section configuration selected from the group consisting of side-by-side and eccentric sheath-core;
d) a plurality of longitudinal grooves; and
e) a groove ratio of about 1.05:1 to about 1.9:1.

Additionally, the invention provides a spun yarn comprising cotton and the polyester bicomponent staple fiber of the invention, as well as fabrics and garments comprising the spun yarn of the invention.

43 Claims, 2 Drawing Sheets

(56) References Cited

U.S. PATENT DOCUMENTS

| | | | |
|---|---|---|---|
| 6,214,264 | B1 | 4/2001 | Aneja |
| 6,371,751 | B1 | 4/2002 | Aneja et al. |
| 6,413,631 | B1 | 7/2002 | Van Alston et al. |
| 6,458,455 | B1 | 10/2002 | Hernandez et al. |
| 6,656,586 | B2 | 12/2003 | Hartzog et al. |
| 6,673,443 | B2 | 1/2004 | Koyanagi et al. |
| 6,835,339 | B2 | 12/2004 | Hernandez et al. |
| 2003/0159423 | A1 | 8/2003 | Hietpas et al. |
| 2004/0067707 | A1 | 4/2004 | Hamilton et al. |

FOREIGN PATENT DOCUMENTS

| | | | |
|---|---|---|---|
| JP | 2000-328382 | | 11/2000 |
| JP | 2001-288621 | | 10/2001 |
| JP | 2002-054029 | | 2/2002 |
| JP | 2002-115149 | A | 4/2002 |
| JP | 2002-129433 | | 5/2002 |
| JP | 2002-180332 | A | 6/2002 |
| JP | 2002-180333 | | 6/2002 |
| WO | WO 97/02373 | | 1/1997 |
| WO | WO 00/77283 | A2 | 12/2000 |
| WO | WO 01/53573 | A1 | 7/2001 |
| WO | WO 01/66837 | A1 | 9/2001 |
| WO | WO 02/22926 | A1 | 3/2002 |
| WO | WO 03/021014 | A | 3/2003 |
| WO | WO 03/062511 | A1 | 7/2003 |

OTHER PUBLICATIONS

International Search Report to PCT/US02/27547.

Kathryn L. Hatch, Textile Science 1993, West Publishing Co., pp. 270-273.

SCALLOPED OVAL BICOMPONENT FIBERS WITH GOOD WICKING, AND HIGH UNIFORMITY SPUN YARNS COMPRISING SUCH FIBERS

FIELD OF THE INVENTION

This invention relates to a polyester bicomponent staple fiber having a scalloped oval cross-section, and to a spun yarn comprising such polyester bicomponent staple fiber and cotton. More particularly, this invention relates to a side-by-side or eccentric sheath-core polyester bicomponent staple fiber comprising poly(trimethylene terephthalate) and at least one polymer selected from the group consisting of poly(ethylene terephthalate), poly(trimethylene terephthalate), and poly (tetramethylene terephthalate) or a combination of such members, the bicomponent staple fiber having stretch and recovery, good wicking, and good carding properties. This invention also relates to high-uniformity spun yarn having high stretch and recovery properties and comprising the scalloped oval cross-section bicomponent fiber. In addition, this invention relates to fabrics made from the spun yarn comprising such bicomponent staple fiber.

BACKGROUND OF THE INVENTION

Polyester bicomponent fibers are generally known. Polyester bicomponent fibers comprising poly(ethylene terephthalate) and poly(trimethylene terephthalate) are disclosed, for example, in U.S. Pat. No. 3,671,379. Polyester bicomponent fibers having a scalloped oval cross-section are disclosed, for example, in U.S. Pat. No. 6,656,586. Yarn comprising polyester fiber and cotton is disclosed in U.S. Pat. No. 6,413,631, Japanese Published Patent Application No. JP2002-115149A, and in United States Published Patent Application No. 2003/0159423 A1. However, such bicomponent fibers can provide poor quality yarns when combined with cotton staple. Fibers with good stretch and recovery, good wicking, and good cardability characteristics are still sought, as are yarns and fabrics comprising such fibers, for the comfort and moisture management desired for today's apparel.

SUMMARY OF THE INVENTION

The present invention provides a polyester bicomponent staple fiber comprising poly(trimethylene terephthalate) and at least one polymer selected from the group consisting of poly(ethylene terephthalate), poly(trimethylene terephthalate), and poly(tetramethylene terephthalate) or a combination of such members, the bicomponent staple fiber having a scalloped oval cross-section shape having an aspect ratio a:b of about 2:1 to about 5:1 wherein 'a' is a fiber cross-section major axis length and 'b' is a fiber cross-section minor axis length, a polymer interface substantially perpendicular to the major axis, a cross-section configuration selected from the group consisting of side-by-side and eccentric sheath-core, a plurality of longitudinal grooves, and a groove ratio of about 1.05:1 to about 1.9:1.

The present invention also provides a polyester bicomponent staple fiber comprising poly(ethylene terephthalate) and poly(trimethylene terephthalate), the bicomponent staple fiber having a scalloped oval cross-section shape having an aspect ratio a:b of about 2.2:1 to about 3.5:1 wherein 'a' is a fiber cross-section major axis length and 'b' is a fiber cross-section minor axis length, a polymer interface substantially perpendicular to the major axis, a cross-section configuration selected from the group consisting of side-by-side and eccentric sheath-core, a plurality of longitudinal grooves, a groove ratio of about 1.1:1 to about 1.5:1, and a tenacity at 10% elongation of about 1.0 cN/dtex to about 3.5 cN/dtex.

The present invention also provides a polyester bicomponent staple fiber mixture comprising a first staple fiber and a second staple fiber, the first and second staple fibers each comprising poly(trimethylene terephthalate) and at least one polymer selected from the group consisting of poly(ethylene terephthalate), poly(trimethylene terephthalate), and poly (tetramethylene terephthalate) or a combination of such members, the first bicomponent staple fiber having a scalloped oval cross-section shape having an aspect ratio a:b of about 2:1 to about 5:1 wherein 'a' is a fiber cross-section major axis length and 'b' is a fiber cross-section minor axis length, a polymer interface substantially perpendicular to the major axis, a cross-section configuration selected from the group consisting of side-by-side and eccentric sheath-core, a plurality of longitudinal grooves, and a groove ratio of about 1.05:1 to about 1.9:1; the second staple fiber having a cross-section configuration selected from the group consisting of side-by-side and eccentric sheath-core, and a cross-section shape selected from the group consisting of substantially oval and scalloped oval, and wherein the polyester bicomponent staple fiber mixture optionally further comprises at least one polyester bicomponent staple fiber.

The present invention further provides a spun yarn comprising cotton and the polyester bicomponent staple fiber of the invention, the spun yarn having a cotton count of about 14 to about 60 and a quality factor of about 0.1 to about 500.

The present invention additionally provides a spun yarn comprising cotton and the polyester bicomponent staple fiber mixture of the invention, the spun yarn having a cotton count of about 14 to about 60 and a quality factor of about 0.1 to about 500.

The present invention also provides a fabric comprising the spun yarn of the invention.

The present invention also provides a fabric comprising the polyester bicomponent staple fiber or the polyester bicomponent staple fiber mixture of the invention and having wicking sufficient for the fabric to be at least 60 percent dry at 14 minutes by the percent dry time test, wherein the fabric has a finished basis weight of about 3.0 ounces per square yard to about 8.5 ounces per square yard.

The present invention also provides a garment comprising the fabric of the invention.

The present invention also provides a nonwoven fabric comprising the staple fiber of the invention.

DETAILED DESCRIPTION OF THE INVENTION

Figure 1:
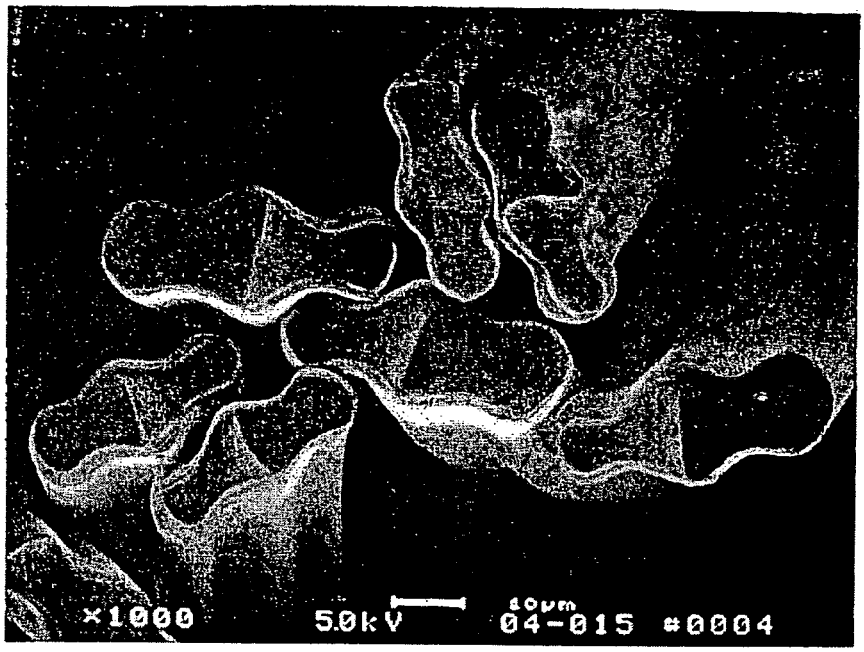
FIG. 1 is an image of a photomicrograph (1000× magnification) of an embodiment of the bicomponent fiber of the invention comprising poly(ethylene terephthalate) and poly (trimethylene terephthalate) and having a tetrachannel scalloped oval cross-section wherein the polymer interface is perpendicular to the major axis.

It has now been found that polyester bicomponent staple fiber comprising poly(trimethylene terephthalate) and having a scalloped oval cross-section shape and a polymer interface substantially perpendicular to the major axis of the cross-section gives spun yarns which have high boil-off shrinkage and unexpectedly high uniformity. High boil-off shrinkage indicates that the yarn possesses high stretch-and recovery properties, which is desirable for today's fabrics. High yarn uniformity can provide uniform fabric appearance, which is a generally desirable quality. The polyester bicomponent staple fiber has a wicking sufficient for a circular knit fabric comprising a spun yarn comprising 100 weight percent (wt %) of the bicomponent fiber to be at least 70 percent dry at 14 minutes by the percent dry time test. A fiber's wicking characteristics can provide moisture management properties to the yarn and to the fabric comprising it, which in turn can provide enhanced comfort to the wearer.

As used herein, "bicomponent fibers" means staple fibers in which two polymers of the same general class have a side-by-side or eccentric sheath-core cross-section configuration and includes both crimped fibers and fibers with latent crimp that has not yet been realized.

As used herein, "side-by-side" means that the two components of the bicomponent fiber are immediately adjacent to one another and that no more than a minor portion of either component is within a concave portion of the other component. "Eccentric sheath-core" means that one of the two components completely surrounds the other component but that the two components are not coaxial.

As used herein, "aspect ratio" means the ratio of the length of the major axis (a) of the fiber cross-section to the length of the minor axis (b) of the fiber cross-section. Aspect ratio may be expressed as a:b.

As used herein, "groove ratio" means the average distance between the surfaces of the outermost bulges, taken from the center, of a grooved fiber cross-section divided by the average distance between the grooves of the fiber cross-section.

As used herein, "polymer interface" means the boundary between the two polymers of the bicomponent fiber.

As used herein, "substantially perpendicular to the major axis" includes within its meaning coincident with or parallel to the cross-section minor axis and does not preclude deviations from parallelism with the cross-section minor axis which may be especially evident adjacent to the surface of the fiber.

One embodiment of the invention is a polyester bicomponent staple fiber comprising poly(trimethylene terephthalate) and at least one polymer selected from the group consisting of poly(ethylene terephthalate), poly(trimethylene terephthalate), and poly(tetramethylene terephthalate) or a combination of such members, the bicomponent staple fiber having a scalloped oval cross-section shape having an aspect ratio a:b of about 2:1 to about 5:1 wherein 'a' is a fiber cross-section major axis length and 'b' is a fiber cross-section minor axis length, a polymer interface substantially perpendicular to the major axis of the cross-section, a cross-section configuration selected from the group consisting of side-by-side and eccentric sheath-core, a plurality of longitudinal grooves, and a groove ratio of about 1.05:1 to about 1.9:1.

Another embodiment is the staple fiber of the invention wherein the aspect ratio a:b is about 2.2:1 to about 3.5:1 and the groove ratio is about 1.1:1 to about 1.5:1.

Another embodiment is the staple fiber of the invention having a tenacity at 10% elongation of about 1.0 cN/dtex to about 3.5 cN/dtex.

Another embodiment is the staple fiber of the invention having a wicking sufficient for a circular knit fabric comprising a spun yarn comprising 100 wt % of the bicomponent fiber to be at least 70 percent dry at 14 minutes by the percent dry time test.

Another embodiment is the staple fiber of the invention having a tow crimp development value of about 25% to about 55% and a tow crimp index value of about 10% to about 25%.

Another embodiment is the staple fiber of the invention having a weight ratio of at least about 30:70 and no more than about 70:30 of poly(trimethylene terephthalate) to the at least one polymer selected from the group consisting of poly(ethylene terephthalate), poly(trimethylene terephthalate), and poly(tetramethylene terephthalate) or a combination of such members.

Another embodiment is the staple fiber of the invention, wherein the fiber has a tetrachannel cross-section shape.

Another embodiment is the staple fiber of the invention, wherein the fiber has a bichannel cross-section shape.

Another embodiment is the staple fiber of the invention, wherein the fiber comprises poly(ethylene terephthalate) and poly(trimethylene terephthalate).

Another embodiment is the staple fiber of the invention, wherein the fiber comprises poly(trimethylene terephthalate) and poly(trimethylene terephthalate).

Another embodiment of the invention is a polyester bicomponent staple fiber comprising poly(ethylene terephthalate) and poly(trimethylene terephthalate), the bicomponent staple fiber having a scalloped oval cross-section shape having an aspect ratio a:b of about 2.2:1 to about 3.5:1 wherein 'a' is a fiber cross-section major axis length and 'b' is a fiber cross-section minor axis length, a polymer interface substantially perpendicular to the major axis of the cross-section, a cross-section configuration selected from the group consisting of side-by-side and eccentric sheath-core, a plurality of longitudinal grooves, a groove ratio of about 1.1:1 to about 1.5:1, and a tenacity at 10% elongation of about 1.0 cN/dtex to about 3.5 cN/dtex.

Yet another embodiment is a spun yarn comprising cotton and the staple fiber of the invention, wherein the spun yarn has a cotton count of about 14 to about 60 and a quality factor of about 0.1 to about 500.

Another embodiment is the spun yarn of the invention, wherein the spun yarn has a total boil-off shrinkage from about 20% to about 45%.

Another embodiment is the spun yarn of the invention having a coefficient of variation of mass from about 13% to about 20%.

Another embodiment is the spun yarn of the invention, wherein the bicomponent staple fiber has a tetrachannel cross-section shape.

Another embodiment is the spun yarn of the invention, wherein the bicomponent staple fiber has a bichannel cross-section shape.

Another embodiment is the spun yarn of the invention, wherein the bicomponent staple fiber is present at a level of about 30 weight percent to about 100 weight percent, based on total weight of the spun yarn.

Another embodiment is the spun yarn of the invention, further comprising about 30 weight percent to about 69 weight percent poly(ethylene terephthalate) monocomponent staple fiber.

Another embodiment is the spun yarn of the invention, wherein the bicomponent staple fiber comprises poly(ethylene terephthalate) and poly(trimethylene terephthalate).

Another embodiment is the spun yarn of the invention, wherein the bicomponent staple fiber comprises poly(trimethylene terephthalate) and poly(trimethylene terephthalate).

Another embodiment of the invention is a spun yarn comprising cotton and a polyester bicomponent staple fiber comprising poly(ethylene terephthalate) and poly(trimethylene terephthalate), the bicomponent staple fiber having a scalloped oval cross-section shape having an aspect ratio a:b of about 2.2:1 to about 3.5:1 wherein 'a' is a fiber cross-section major axis length and 'b' is a fiber cross-section minor axis length, a polymer interface substantially perpendicular to the major axis of the cross-section, a cross-section configuration selected from the group consisting of side-by-side and eccentric sheath-core, a plurality of longitudinal grooves, a groove ratio of about 1.1:1 to about 1.5:1, and a tenacity at 10% elongation of about 1.0 cN/dtex to about 3.5 cN/dtex, wherein the spun yarn has a cotton count of about 14 to about 60 and a quality factor of about 0.1 to about 500.

Yet another embodiment is a fabric comprising the spun yarn of the invention.

Another embodiment is a fabric comprising the staple fiber of the invention and having wicking sufficient for the fabric to be at least 60 percent dry at 14 minutes by the percent dry time test, wherein the fabric has a finished basis weight of about 3.0 ounces per square yard to about 8.5 ounces per square yard.

Another embodiment is the fabric of the invention, wherein the finished basis weight is about 6.0 ounces per square yard to about 8.0 ounces per square yard.

Another embodiment is the fabric of the invention comprising a polyester bicomponent staple fiber comprising poly (ethylene terephthalate) and poly(trimethylene terephthalate), the bicomponent staple fiber having a scalloped oval cross-section shape having an aspect ratio a:b of about 2.2:1 to about 3.5:1 wherein 'a' is a fiber cross-section major axis length and 'b' is a fiber cross-section minor axis length, a polymer interface substantially perpendicular to the major axis of the cross-section, a cross-section configuration selected from the group consisting of side-by-side and eccentric sheath-core, a plurality of longitudinal grooves, a groove ratio of about 1.1:1 to about 1.5:1, and a tenacity at 10% elongation of about 1.0 cN/dtex to about 3.5 cN/dtex, wherein the fabric has a finished basis weight of about 3.0 ounces per square yard to about 8.5 ounces per square yard.

Another embodiment is the fabric of the invention, wherein the finished basis weight is about 6.0 ounces per square yard to about 8.0 ounces per square yard.

Yet another embodiment of the invention is a polyester bicomponent staple fiber mixture comprising a first staple fiber and a second staple fiber, said first and said second staple fiber each comprising poly(trimethylene terephthalate) and at least one polymer selected from the group consisting of poly (ethylene terephthalate), poly(trimethylene terephthalate), and poly(tetramethylene terephthalate) or a combination of such members, said first bicomponent staple fiber having a scalloped oval cross-section shape having an aspect ratio a:b of about 2:1 to about 5:1 wherein 'a' is a fiber cross-section major axis length and 'b' is a fiber cross-section minor axis length, a polymer interface substantially perpendicular to the major axis, a cross-section configuration selected from the group consisting of side-by-side and eccentric sheath-core, a plurality of longitudinal grooves, and a groove ratio of about 1.05:1 to about 1.9:1, the second staple fiber having a cross-section configuration selected from the group consisting of side-by-side and eccentric sheath-core, and a cross-section shape selected from the group consisting of substantially oval and scalloped oval, and wherein the polyester bicomponent staple fiber mixture optionally further comprises at least one polyester bicomponent staple fiber.

Yet another embodiment is a spun yarn comprising cotton and the staple fiber mixture of the invention, wherein the spun yarn has a cotton count of about 14 to about 60 and a quality factor of about 0.1 to about 500.

Another embodiment is a spun yarn comprising cotton and the staple fiber mixture of the invention, the spun yarn having a total boil-off shrinkage from about 20% to about 45%.

Another embodiment is a spun yarn comprising cotton and the staple fiber mixture of the invention, the spun yarn having a coefficient of variation of mass from about 13% to about 20%.

Another embodiment is a spun yarn comprising cotton and the staple fiber mixture of the invention, wherein the bicomponent staple fiber mixture is present at a level of about 30 weight percent to about 100 weight percent, based on total weight of the spun yarn.

Another embodiment is a spun yarn comprising cotton and the staple fiber mixture of the invention, the spun yarn further comprising about 30 weight percent to about 69 weight percent poly(ethylene terephthalate) monocomponent staple fiber.

Another embodiment is a spun yarn comprising cotton and the staple fiber mixture of the invention, wherein the bicomponent staple fiber mixture comprises poly(ethylene terephthalate) and poly(trimethylene terephthalate).

Yet another embodiment is a fabric comprising a spun yarn comprising cotton and the polyester bicomponent staple fiber mixture of the invention, wherein the spun yarn has a cotton count of about 14 to about 60 and a quality factor of about 0.1 to about 500.

Another embodiment is a fabric comprising a spun yarn comprising cotton and the polyester bicomponent staple fiber mixture of the invention, wherein the bicomponent staple fiber mixture is present at a level of about 30 weight percent to about 100 weight percent, based on total weight of the spun yarn.

Another embodiment is a fabric comprising a spun yarn comprising cotton and the staple fiber mixture of the invention, the spun yarn further comprising about 30 weight percent to about 69 weight percent poly(ethylene terephthalate) monocomponent staple fiber.

Another embodiment is a fabric comprising a spun yarn comprising cotton and the staple fiber mixture of the invention, wherein the bicomponent staple fiber mixture comprises poly(ethylene terephthalate) and poly(trimethylene terephthalate).

Another embodiment is a fabric comprising the staple fiber mixture of the invention and having wicking sufficient for the fabric to be at least 60 percent dry at 14 minutes by the percent dry time test, wherein the fabric has a finished basis weight of about 3.0 ounces per square yard to about 8.5 ounces per square yard.

Another embodiment is a fabric comprising the staple fiber mixture of the invention and having wicking sufficient for the fabric to be at least 60 percent dry at 14 minutes by the percent dry time test, wherein the fabric has a finished basis weight of about 6.0 ounces per square yard to about 8.0 ounces per square yard.

Yet another embodiment is a garment comprising the fabric of the invention.

Another embodiment is a nonwoven fabric comprising the staple fiber of the invention.

The polyester bicomponent staple fiber of the invention comprises poly(trimethylene terephthalate) and at least one polymer selected from the group consisting of poly(ethylene terephthalate), poly(trimethylene terephthalate), and poly (tetramethylene terephthalate) or a combination of such members. The fiber has a substantially oval cross-section shape and has a plurality of longitudinal grooves in the surface thereof. Such fibers can be considered to have a "scalloped oval" cross-section, for example of the type shown in FIG. 3. The average bulge angle of the inner bulges, that is the average angle q between two lines tangent to the cross-section surface and laid at the point of inflection of curvature (in fibers with flat-sided grooves, the "deepest" part of the groove) on each side of each of the inner bulges, can be at least about 30°. The two lines tangent to the cross-section surface should cross on the same side of the fiber as the bulge whose angle is being measured. Fibers having two such grooves can be termed "bichannel", fibers having four such grooves can be termed "tetrachannel", six grooves "hexachannel", eight grooves "octachannel", and so on.

In addition to having longitudinal grooves which provide the "scalloped" periphery of the fiber cross-section, the fiber of the invention has a substantially oval cross-section shape with an aspect ratio a:b of about 2:1 to about 5:1, for example from about 2.1:1 to about 3.9:1, or from about 2.2:1 to about 3.5:1. When the aspect ratio is too high or too low, the fiber can exhibit undesirable glitter and low dye yield, and spun yarn comprising the fiber can be of poor quality and insufficient uniformity.

The groove ratio of the fiber cross-section may be at least about 0.75:1, for example at least about 1.05:1, or about 1.1:1, or about 1.5:1, and no greater than about 1.9:1. When the groove ratio is too low, the fiber may provide insufficient wicking, and when it is too high, the fiber may be too easily split.

The polyester bicomponent staple fiber of the invention has a polymer interface between the two polyesters which is substantially perpendicular to the major axis of the fiber cross-section. The polymer interface can be substantially linear or curved.

The polyester bicomponent staple fiber of the invention comprises poly(trimethylene terephthalate) and at least one polymer selected from the group consisting of poly(ethylene terephthalate), poly(trimethylene terephthalate), and poly (tetramethylene terephthalate) or a combination of such members, in a weight ratio of from about 30:70 to about 70:30. The polymers may be, for example, poly(ethylene terephthalate) and poly(trimethylene terephthalate), poly(trimethylene terephthalate) and poly(tetramethylene terephthalate), or poly(trimethylene terephthalate) and poly(trimethylene) terephthalate, for example of different intrinsic viscosities, although different combinations are also possible. Alternatively, the compositions can be similar, for example a poly(trimethylene terephthalate) homopolyester and a poly (trimethylene terephthalate) copolyester, optionally also of different viscosities. Other polyester bicomponent combinations are also possible, such as poly(ethylene terephthalate) and poly(tetramethylene terephthalate), or a combination of poly(ethylene terephthalate) and poly(ethylene terephthalate), for example of different intrinsic viscosities, or a poly (ethylene terephthalate) homopolyester and a poly(ethylene terephthalate) copolyester.

One or both of the polyesters comprising the fiber of the invention can be copolyesters, and "poly(ethylene terephthalate)", "poly(trimethylene terephthalate)", and "poly(tetramethylene terephthalate)" include such copolyesters within their meanings. For example, a copoly(ethylene terephthalate) can be used in which the comonomer used to make the copolyester is selected from the group consisting of linear, cyclic, and branched aliphatic dicarboxylic acids having 4-12 carbon atoms (for example butanedioic acid, pentanedioic acid, hexanedioic acid, dodecanedioic acid, and 1,4-cyclohexanedicarboxylic acid); aromatic dicarboxylic acids other than terephthalic acid and having 8-12 carbon atoms (for example isophthalic acid and 2,6-naphthalenedicarboxylic acid); linear, cyclic, and branched aliphatic diols having 3-8 carbon atoms (for example 1,3-propane diol, 1,2-propanediol, 1,4-butanediol, 3-methyl-1,5-pentanediol, 2,2-dimethyl-1,3-propanediol, 2-methyl-1,3-propanediol, and 1,4-cyclohexanediol); and aliphatic and araliphatic ether glycols having 4-10 carbon atoms (for example, hydroquinone bis(2-hydroxyethyl) ether, or a poly(ethyleneether) glycol having a molecular weight below about 460, including diethyleneether glycol). The comonomer can be present to the extent that it does not compromise the benefits of the invention, for example at levels of about 0.5-15 mole percent based on total polymer ingredients. Isophthalic acid, pentanedioic acid, hexanedioic acid, 1,3-propane diol, and 1,4-butanediol are preferred comonomers.

The copolyester(s) can also be made with minor amounts of other comonomers, provided such comonomers do not have an adverse effect on the physical properties of the fiber. Such other comonomers include 5-sodium-sulfoisophthalate, the sodium salt of 3-(2-sulfoethyl) hexanedioic acid, and dialkyl esters thereof, which can be incorporated at about 0.2-4 mole percent based on total polyester. For improved acid dyeability, the (co)polyester(s) can also be mixed with polymeric secondary amine additives, for example poly(6,6'-imino-bishexamethylene terephthalamide) and copolyamides thereof with hexamethylenediamine, for example phosphoric acid and phosphorous acid salts thereof. Small amounts, for example about 1 to 6 milliequivalents per kg of polymer, of tri- or tetra-functional comonomers, for example trimellitic acid (including precursors thereto) or pentaerythritol, can be incorporated for viscosity control.

The fiber of the present invention can also comprise conventional additives such as antistats, antioxidants, antimicrobials, flameproofing agents, dyestuffs, light stabilizers, and delustrants such as titanium dioxide, provided they do not detract from the benefits of the invention.

After the fibers have been drawn and heat-treated, it is advantageous to apply a finish to the bicomponent fibers, for example to the tow before cutting it to staple. The finish can be applied at a level (percent by total weight) of 0.05-0.30%. The finish can comprise 1) a blend of alkyl or branched phosphate esters, or 2) the potassium, calcium, or sodium salts of the corresponding phosphate acids, or a blend of the those two classes in any proportion, each of which can contain from 6 to 24 total carbon atoms in the aliphatic segments. The finish can also contain poly(ethylene oxide) and/or poly(propylene oxide), or short chain segments of such polyethers can be attached by esterification to aliphatic acids such as lauric acid, or by an ether linkage to alcohols such as sorbitol, glycerol, castor oil, coconut oil, or the like. Such compounds can also comprise amine groups. The finish can also contain minor amounts (for example less than 10%) of functional additives such as silicones or fluorochemicals. The finish can contain a blend of the potassium salts of mono- and di-acids containing about 18 carbons and an ethoxylated polyether containing 4-10 ethylene oxide segments made by reaction of an n-alkyl alcohol containing from 12 to 18 carbon atoms with a blend of polyethers.

It is unnecessary that the crimps of the bicomponent fibers in the tow precursor to the staple fiber be deregistered, that is treated in such a way as to misalign the crimps of the fibers. Similarly, the bicomponent staple tow does not require mechanical crimping in order for staple made therefrom to display good processability and useful properties.

The bicomponent fiber can have an elongation to break of about 15% to about 50%, for example about 15% to about 35%, or for example about 15% to about 25%, or about 15% to about 20%.

The bicomponent staple fiber can have a tow development ("CD") value of about 25% to about 55% and a crimp index ("CI") value of about 10% to about 25%. When the CD is lower than about 25%, a spun yarn comprising the fiber typically has too little total boil-off shrinkage to generate good recovery in fabrics made therefrom. When the CI value is low, mechanical crimping can be necessary for satisfactory carding and spinning. When the CI value is high, the bicomponent staple can have too much crimp to be readily cardable, and the uniformity of the spun yarn can be inadequate. When CI is lower in the range of acceptable values, higher proportions of polyester bicomponent staple fibers can be used without compromising cardability and yarn uniformity. When CD is higher in the range of acceptable values, lower proportions of bicomponent staple can be used without compromising total boil-off shrinkage.

The bicomponent staple fiber can be of any suitable length. If the bicomponent staple fiber is too short, it can be difficult to card. If it is too long, it can be difficult to spin on cotton system equipment. Accordingly, the length is typically sufficient for carding while also spinnable on cotton system equipment. An example of suitable bicomponent staple fiber length is about 1.3 cm to about 5.5 cm. The cotton can have a length of from about 2 to about 4 cm. The bicomponent fiber can have a linear density of about 0.7 dtex to about 3.0 dtex, for example about 0.9 dtex to about 2.5 dtex. When the bicomponent staple has a linear density above about 3.0 dtex, the yarn can have a harsh hand, and it can be hard to blend with the cotton. When it has a linear density below about 0.7 dtex, it can be difficult to card.

The tenacity-at-break of the bicomponent staple fiber needs to be sufficient to avoid breakage during carding but not so high as to cause undesirable pilling of a fabric comprising the fiber. The tenacity-at-break can be, for example, about 3.2 to about 5.0 cN/dtex. The tenacity at 10% elongation (T10) needs to be sufficient to permit good carding of the bicomponent staple fiber, for example about 1.0 cN/dtex to about 3.5 cN/dtex, or for example about 1.8 to 3.0 cN/dtex. The weight ratio of one polyester to the other polyester can be about 30:70 to about 70:30, for example about 40:60 to about 60:40, or for example about 50:50.

The bicomponent staple fiber can comprise one scalloped oval cross-section shape, or the bicomponent staple fiber can comprise a mixture of two or more cross-section shapes, at least one of the shapes having a scalloped oval cross-section. For example, the bicomponent staple fiber may be a mixture of staple fibers having a tetrachannel scalloped oval cross-section shape and of staple fibers having a substantially oval cross-section shape without grooves. Alternatively, for example, the bicomponent staple fiber may be a mixture of staple fibers having a tetrachannel scalloped oval cross-section shape and of staple fibers having a hexachannel scalloped oval cross-section shape. As an additional example, the bicomponent staple fiber may be a mixture of staple fibers, some having a tetrachannel shape, some having a hexachannel shape, and some having an octachannel shape. The mixture of cross-section shapes may be obtained by physically mixing staple fibers of different cross-section shapes. Alternatively, the mixture may be obtained by spinning bicomponent fibers from mixed shape capillaries, for example some capillaries providing a tetrachannel shape and some providing a hexachannel shape. A mixture of cross-section shapes may also be obtained by using two differently shaped spinnerets and blending the tow bands together.

The poly(ethylene terephthalate) can have an intrinsic viscosity (IV) of about 0.50-0.65 dl/g. The poly(trimethylene terephthalate) can have an intrinsic viscosity of about 0.8-1.2 dl/g. It is believed that the poly(tetramethylene terephthalate) can have an intrinsic viscosity of about 0.6-1.1 dl/g.

The ability of a fiber or fabric to wick moisture is the ability to distribute moisture to dry areas and thus increase the wet surface area. Increased surface area permits faster evaporation of the moisture and faster drying of the fabric. Fibers and fabrics which have improved wicking are generally perceived by the wearer as imparting greater comfort. The wicking of the scalloped oval bicomponent fiber of the invention is sufficient that fabric comprising the staple fiber and having a finished basis weight of about 3.0 ounces per square yard (oz/yd$^2$) to about 8.5 oz/yd$^2$ can be at least 60 percent dry at 14 minutes by the percent dry time test. The wicking of the scalloped oval bicomponent fiber of the invention is sufficient that a scoured, single jersey circular knit fabric of about 7.9 oz/yd$^2$ finished basis weight and comprising a 22 Ne spun yarn comprising 100 wt % of about 1.5 denier (about 1.65 dtex) polyester bicomponent staple fiber of the invention can be at least about 70 percent dry at 14 minutes by the percent dry time test. As used herein, the term "good wicking" is defined by the preceding statements. Typically, lower fabric basis weight can increase moisture wicking and reduce fabric drying time. Nonuniformities or imperfections in the fabric can influence moisture wicking and affect percent dry time test results.

FIG. 1 is an image of a photomicrograph of the fibers prepared according to Example 1. The polymer interface is substantially perpendicular to the cross-section major axis. The blurred outline of some of the fiber cross sections is believed to be an artifact of the process used to cut the fibers.

Figure 2:
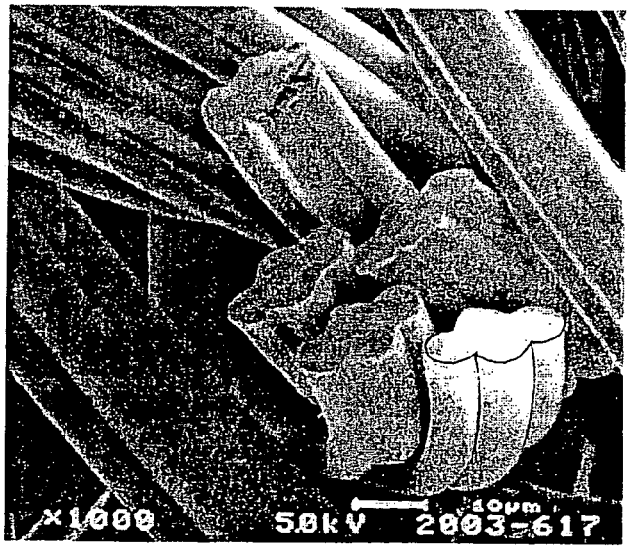
FIG. 2 is an image of a photomicrograph (1000× magnification) of a bicomponent fiber comprising poly(ethylene terephthalate) and poly(trimethylene terephthalate) having a scalloped oval cross-section wherein the polymer interface is parallel to the major axis.

FIG. 2 is an image of a photomicrograph of the fibers prepared according to Comparison Example 1.

Figure 3A:
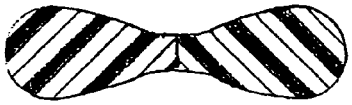
FIGS. 3A, 3B, and 3C are graphical representations of idealized cross-sections of embodiments of the bicomponent fiber of the invention.
Figure 3B:
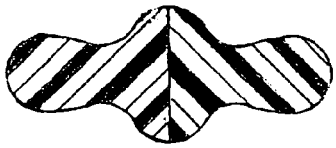
Figure 3C:
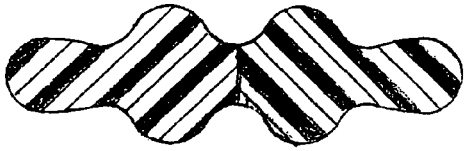

FIG. 3A shows a graphical representation of an idealized bichannel bicomponent fiber having the polymer interface substantially perpendicular to the major axis of the fiber cross-section. Actual bichannel bicomponent fibers can be asymmetrical along the polymer interface, that is, the bichannel fibers may appear lopsided with more fiber cross-section area on one side of the polymer interface than on the other. FIG. 3B shows a graphical representation of an idealized tetrachannel bicomponent fiber having the polymer interface substantially perpendicular to the cross-section major axis. FIG. 3C shows a graphical representation of an idealized hexachannel bicomponent fiber having the polymer interface substantially perpendicular to the cross-section major axis.

Figure 4A:
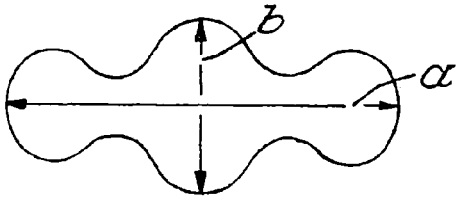
FIGS. 4A and 4B are graphical representations showing cross-sectional dimensions of embodiments of the fiber of the invention.
Figure 4B:
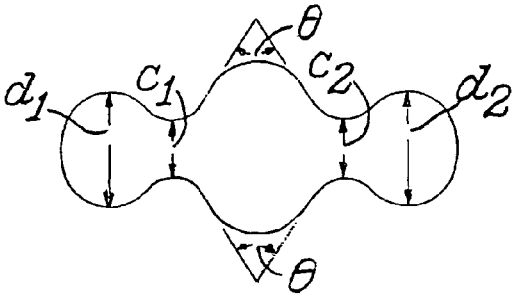

FIG. 4A shows an idealized cross-section of a fiber of the invention in which 'a' indicates the length of the major axis of the cross-section and 'b' indicates the length of the minor axis of the cross section. FIG. 4B shows a cross-section of a fiber of the invention in which 'd1' and 'd2' indicate the distances between the outermost bulges of the fiber, taken from the center, and 'c1' and 'c2' indicate the distances between the grooves of the fiber. FIG. 4B also shows angles q, each formed by two lines tangent to the cross-section surface and laid at the point of inflection of curvature on each side of an inner bulge. Cross-section aspect ratios and groove ratios of the fibers in the Examples were measured from photomicrographs of the fiber cross-sections. Referring to FIG. 4A, the aspect ratio of a tetrachannel fiber was calculated as a/b. Referring to FIG. 4B, the groove ratio of a tetrachannel fiber was calculated as (d1/c1+d2/c2)/2. The groove ratio of a scalloped oval cross-section which is not symmetrical across the polymer interface, for example some bichannel fibers, was calculated using the smaller bulge.

Figure 5:
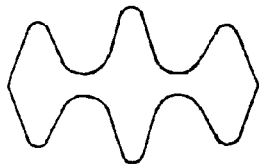
FIG. 5 shows a typical spinneret orifice for spinning fibers with a tetrachannel scalloped oval cross-section.
Figure 6:
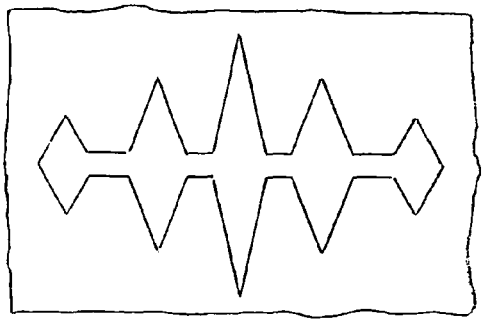
FIG. 6 shows a typical spinneret orifice for spinning fibers with an octachannel scalloped oval cross-section.

FIG. 5 shows a typical spinneret orifice for spinning fibers with a tetrachannel scalloped oval cross-section. FIG. 6 shows a typical spinneret orifice for spinning fibers with an octachannel scalloped oval cross-section.

The scalloped oval bicomponent fibers can be spun from spin packs known in the art, for example as disclosed in U.S. Pat. No. 6,656,586, with the orifices arranged to give the desired interface orientation.

The spun yarn of the invention has a cotton count of about 8 to about 60, for example about 14 to about 60, or about 16 to about 40, and comprises cotton and a polyester bicomponent staple fiber comprising poly(trimethylene terephthalate) and at least one polymer selected from the group consisting of poly(ethylene terephthalate), poly(trimethylene terephthalate), and poly(tetramethylene terephthalate) or a combination of such members. The spun yarn can have about 1 to about 70 thin regions per 1000 meters, for example about 15 to about 50 thin regions per 1000 meters. The spun yarn can have about 1 to about 400 thick regions, for example about 40 to about 320 per 1000 meters, and about 1 to about 200 neps per 1000 meters, for example about 10 to about 175. The spun yarn can have a total boil-off shrinkage of about 20% to about 45%, for example about 30% to about 45%. When the total boil-off shrinkage is less than about 20%, the stretch-and-recovery properties of the yarn are too low when the yarns are woven or knitted into fabrics.

Yarn quality factor is a very useful measure of yarn quality, which can be calculated from the number of thin regions, thick regions, neps, coefficient of variation of mass, and yarn strength. The spun yarn can have a yarn quality factor of about 0.1 to about 800, for example about 0.1 to about 510, or about 0.1 to about 200. When the quality factor is too high, the yarn can be insufficiently uniform.

Another way to describe uniformity of spun yarn is in terms of the coefficient of variation as determined with a Uniformity 1-B Tester. The spun yarn of the invention can have a coefficient of variation of mass of about 13% to about 20%, for example about 15% to about 17%.

The spun yarn of the invention comprises the polyester bicomponent staple fiber of the invention, either as a single scalloped oval cross-section shape or as a polyester bicomponent staple fiber mixture having at least one scalloped oval cross-section shape. The spun yarn can have a tenacity-at-break of about 10 to about 20 cN/tex. When the tenacity is too low, yarn spinning can be difficult and weaving efficiency and fabric strength can be reduced. The linear density of the spun yarn can be about 0.1 to about 700 denier (110 to 770 dtex).

In the spun yarn, the polyester bicomponent staple fiber can be present at a level of about 30 wt % to about 100 wt %, based on the total weight of the spun yarn. When the yarn of the invention comprises less than about 30 wt % polyester bicomponent, the yarn can exhibit inadequate stretch and recovery properties. When the bicomponent staple fiber is present at a level below 100 wt % but above about 30 wt %, the spun yarn can comprise a second staple fiber selected from the group consisting of monocomponent poly(ethylene terephthalate), monocomponent poly(trimethylene terephthalate), cotton, wool, acrylic, and nylon staple fibers which can be present at about 1 wt % to about 70 wt %, based on total weight of the spun yarn. Optionally, the spun yarn of the invention can further comprise a third staple fiber selected from the same group and present at about 1 wt % to about 69 wt % based on the total weight of the spun yarn; together the second and third staple fibers can be present at about 1 wt % to about 70 wt %, based on total weight of the spun yarn.

The staple fibers may be blended by a variety of means, for example by intimate blending. "Intimate blending" means the process of gravimetrically and thoroughly mixing dissimilar fibers in an opening room (for example with a weigh-panhopper feeder) before feeding the mixture to the card or of mixing the fibers in a dual feed chute on the card. The blended fibers are further processed by carding to form a card sliver, drawing the card sliver, doubling and redrawing the card sliver up to 3 times, converting the drawn sliver to roving, and ring-spinning the roving, for example with a twist multiplier of about 3 to 5.5, to form the spun yarn.

The yarn may be spun by commercially available processes such as ring, open end, air jet, and vortex spinning.

Knit and woven stretch fabrics can be made from the spun yarn of the invention. Stretch fabric examples include circular, flat, and warp knits, and plain, twill, and satin wovens. The high uniformity and stretch characteristics of the spun yarn are typically carried through to the fabric as uniform appearance and high stretch and recovery, which in combination with the ability to wick and thus provide moisture management, are highly desirable for apparel. Garments such as pants, shirts, sportswear, uniforms, underwear, outer wear, gloves, and hats can be made from the stretch fabrics comprising the spun yarn of the invention.

Stretch nonwoven fabrics can be made from the bicomponent staple fiber of the invention. Nonwoven fabrics can be used for expendable items such as wiping cloths, diapers, hospital sheets, napkins, and personal care items. Nonwoven fabrics can also be used as the base material for coated fabrics and in a variety of other applications, such as apparel and home furnishings.

Analytical Methods

Intrinsic viscosity ("IV") of the polyesters was measured with a Viscotek Forced Flow Viscometer Model Y-900 at a 0.4% concentration at 19° C. and according to ASTM D4603-96 but in 50/50 wt % trifluoroacetic acid/methylene chloride or another standard solvent instead of the prescribed 60/40 wt % phenol/1,1,2,2-tetrachloroethane.

Linear density and tensile properties of the fibers were measured with a Favimat instrument from Textechno (Germany) in accordance with ASTM methods D1577 for linear density and D3822 for tenacity and elongation. Measurements were done on a minimum of 25 fibers and averages are reported.

Within each bicomponent staple fiber sample, the fibers had substantially equal linear densities and polymer ratios of poly(ethylene terephthalate) to poly(trimethylene terephthalate). No mechanical crimp was applied to the bicomponent staple fibers in the Examples.

Finish levels are given as wt % finish on fiber and were obtained on bicomponent fiber cut from the tow, using methanol to extract the finish oils from the fiber, evaporating the methanol, and then gravimetrically determining the weight of the finish so extracted. Weight percent finish was calculated as shown in the following formula:

$$wt\ \%\ \text{finish} = \frac{100 \times (\text{weight of finish})}{(\text{weight of finish} + \text{weight of fiber})}$$

Unless otherwise noted, the following methods of measuring tow Crimp Development and tow Crimp Index of the bicomponent fiber were used in the Examples. The methods described here are numerically equivalent to the methods used in United States Published Patent Application No. 2003/0159423 A1. Minor modifications are indicated here which improve operational efficiency. To measure tow Crimp Index ("CI"), a 1.2-meter sample of polyester bicomponent tow was weighed, and its denier was calculated; the tow linear density was typically about 40,000 to 50,000 denier (44,000 to 55,000 dtex). A single knot was tied at each end of the tow. Tension was applied to the vertical tow sample by applying a first clamp at the lower knot and hanging at least 40 mg/den (0.035 dN/tex) of weight on the knot at the upper end of the tow, which was directed over a stationary roller located at 1.1 m from the bottom end of the tow. The weight was selected so as to straighten the crimp from the tow without breaking the fibers. At this point the tow was essentially straight and all fiber crimp was removed. Then, a second clamp was applied to the tow 100 cm above the first clamp while the weight was in place. Next, the weight at the upper end of the tow was removed, and a 1.5 mg/den (0.0013 dN/tex) weight was attached to the tow just below the lower knot, the first clamp was removed from the lower knot, and the sample was allowed to retract against the 0.0013 dN/tex weight. The length of the retracted tow from the second clamp to the lower knot was measured in centimeters and identified as Lr. C.I. was calculated according to the formula below. To measure tow Crimp Development ("CD"), the same procedure was carried out, except that the 1.2-meter sample was placed—unrestrained—in an oven at 105° C. for 5 minutes, then allowed to cool at room temperature for at least two minutes before beginning the measuring procedure.

$$\text{CI and CD}(\%) = 100 \times (100\ \text{cm} - Lr)/100\ \text{cm}$$

Because merely cutting the tow into staple fibers does not affect the crimp, it is intended and is to be understood that references herein to crimp values of staple fibers indicate measurements made on the tow precursors to such fibers.

Cardability of staple fibers which contained adequate finish to control static was evaluated by visual inspection of the card web and the coiling of the sliver. Fibers which produced a card web which was uniform in appearance and free of neps, and which had no coiler chokes during processing into sliver, were considered to exhibit good cardability. Fibers which did not meet these criteria were considered to have poor cardability.

Percent dry time tests, also known as percent dry with time tests or horizontal wicking determinations, were performed on fabric Comparison Examples and on fabric samples comprising spun yarn comprising the scalloped oval polyester bicomponent staple fiber. Percent dry time tests were done using a balance interfaced to a computer for automated calculations, for example a Mettler balance AE163 connected to a computer running a Mettler BalanceLink 3.0 program. The weight ($W_{fabric}$) of a circular sample of fabric 2 inches (5.1 cm) in diameter was obtained and recorded. Using an automated pipettor, 0.10 gram of tap water was placed on the balance and its exact weight ($W_{H2O}$) recorded. The circular fabric sample was immediately centered over and then placed on the water; the total weight of fabric and water ($W_{total}$) was recorded at that time (time=zero minutes) and every two minutes thereafter for the next 30 minutes. Percent dry results for a given time were calculated according to the following formula:

$$\%\ \text{Dry} = 100 - [(W_{total} - W_{fabric})/W_{H2O}] \times 100$$

Percent dry time test results in the Tables were rounded to the nearest whole number.

To determine the total boil-off shrinkage ("B.O.S.") of the spun yarns in the Examples, the yarn was made into a skein of 25 wraps on a standard skein winder. While the sample was held taut on the winder, a 10 inch (25.4 cm) length ("$L_0$") was marked on the sample with a dye marker. The skein was removed from the winder, placed in boiling water for 1 minute without restraint, removed from the water, and allowed to dry at room temperature. The dry skein was laid flat, and the distance between the dye marks was again measured ("$L_{bo}$"). Total boil-off shrinkage was calculated from the following formula:

$$\text{Total B.O.S}(\%) = 100 \times (L_0 - L_{bo})/L_0$$

Using the same sample that had been subjected to the total boil-off shrinkage test, the 'true' shrinkage of the spun yarn was measured by applying a 200 mg/den (0.18 dN/tex) load, measuring the extended length, and calculating the percent difference between the before-boil-off and extended after-boil-off lengths. The true shrinkage of the samples was generally less than about 5%. Since true shrinkage constitutes only a minor fraction of total boil-off shrinkage, the latter is used herein as a reliable measure of the stretch-and-recovery characteristics of the spun yarns. Higher total boil-off shrinkage corresponds to desirably higher stretch-and-recovery.

Yarn count is a term commonly used to describe the linear density of a spun yarn. The term "English Cotton Count," also referred to as "CC" or "Ne," means the number of hanks, i.e., 840 yards, that weigh 1 lb.

The uniformity of the spun yarns along their length was determined with a Uniformity 1-B Tester (made by Zellweger Uster Corp.) and reported as Coefficient of Variation ("CV") in percentage units. In this test, yarn was fed into the Tester at 400 yds/min (366 m/min) for 2.5 minutes, during which the mass of the yarn was measured approximately every 8 mm. The standard deviation of the resulting data was calculated, multiplied by 100, and divided by the average mass of the yarn tested to arrive at percent CV. The Uniformity 1-B tester also determined an average numerical count of the number of thick regions, thin regions, and neps per 1000 yards of yarn. Thick regions in the yarn are those places having a mass at least 50% greater than the average mass. Thin regions in the yarn are those places having a mass at least 50% lower than the average mass. Neps are those places in the yarn having a mass at least 200% more than the average mass.

Spun yarn tensile properties were determined using a Tensojet (also made by Zellweger Uster Corp.). Tenacities are reported as cN/tex.

Yarn Quality Factor was calculated as shown in the following formula:

$$\text{Yarn Quality Factor} = ([A+B+C] \times D)/E$$

wherein

A is the number of thick regions per 1000 yards of yarn,

B is the number of thin regions per 1000 yards of yarn,

C is the number of neps per 1000 yards of yarn,

D is the coefficient of variation of yarn mass ("CV") in percentage units, each as measured by the Uster Uniformity 1-B tester, and E is the tenacity-at-break of the yarn in cN/tex.

Three samples of each fabric are die-punched with a 10 cm diameter die. Each cut-out fabric sample is weighed in grams and the results for the three samples are averaged. The "fabric weight" is then calculated as grams per square meter ($g/m^2$), which is converted to ounces per square yard ($oz/yd^2$) by dividing by 33.91.

Fabrics are evaluated for percent elongation (available fabric stretch) under a specified load (i.e., force) in the direction of stretch. Three samples of dimensions 60 cm×6.5 cm are cut from the fabric. The long dimension (60 cm) corresponds to the stretch direction. The samples are unraveled so that each is 5.0 cm in width and parallel to the grain of the fabric in the direction being tested. The samples are then conditioned for at least 16 hours at 20° C. (+/−2° C.) and 65% relative humidity, (+/−2%).

A first benchmark is made across the width of each sample, at 6.5 cm from a sample end. A second benchmark is made across the sample width at 50.0 cm from the first benchmark. The excess fabric from the second benchmark to the other end of the sample is used to form and stitch a loop into which a metal pin can be inserted. A notch is then cut into the loop so that weights can be attached to the metal pin.

The sample non-loop end is clamped and the fabric sample is hung vertically. A 30 Newton (N) weight (6.75 LB) is attached to the metal pin through the hanging fabric loop, so that the fabric sample is stretched by the weight. The sample is "exercised" by allowing it to be stretched by the weight for three seconds, and then manually relieving the force by lifting the weight. This is done three times. The weight is then allowed to hang freely, thus stretching the fabric sample. The distance in millimeters between the two benchmarks is measured while the fabric is under load, and this distance is designated ML. The original distance between benchmarks (i.e., unstretched distance) is designated GL. The percent fabric elongation for each individual sample is calculated as follows:

$$\%\ \text{Elongation}(E\%)=((ML-GL)/GL)\times 100.$$

The three elongation results are averaged for the final result.

After stretching, a fabric with no growth (unrecovered stretch) would recover exactly to its original length before stretching. Typically, however, stretch fabrics will not fully recover and will be slightly longer after extended stretching. This slight increase in length is termed "growth."

The above fabric elongation test must be completed before the growth test. Only the stretch direction of the fabric is tested. For two-way stretch fabric both directions are tested. Three samples, each 55.0 cm×6.0 cm, are cut from the fabric. These are different samples from those used in the elongation test. The 55.0 cm direction should correspond to the stretch direction. The samples are unraveled so that each is 5.0 cm in width and parallel to the grain of the fabric in the direction being tested. The samples are conditioned at temperature and humidity as in the above elongation test. Two benchmarks exactly 50 cm apart are drawn across the width of the samples.

The known elongation percent (E %) from the elongation test is used to calculate a length of the samples at 80% of this known elongation. This is calculated as $$E(\text{length})\text{at } 80\%=(E\%/100)\times 0.80\times L,$$

where L is the original length between the benchmarks (i.e., 50.0 cm). Both ends of a sample are clamped and the sample is stretched until the length between benchmarks equals L+E (length) as calculated above. This stretch is maintained for 30 minutes, after which time the stretching force is released and the sample is allowed to hang freely and relax. After 60 minutes the percent growth is measured as $$\%\ \text{Growth}=(L_2\times 100)/L,$$

where $L_2$ is the increase in length between the sample benchmarks after relaxation and L is the original length between benchmarks. This percent growth is measured for each sample and the results averaged to determine the growth number.

Circular knit fabrics are evaluated for percent stretch in the wale or course direction under a specified load in the direction of stretch. Two samples of dimensions 1.25 inches by 12 inches are cut from the knit fabric. The long dimension (12 inches) corresponds to the course direction for one sample and to the wale direction for the other. The sample is hung vertically with a clamp at each end such that the length of unstretched fabric between the clamps is set to 27.5 centimeters. One of the clamps is fixed in place while the other is capable of moving on a track in order to extend the fabric. A 6.75 pound (30 Newtons) weight is hung on the movable clamp, and the length of the extended fabric is measured in centimeters. Percent stretch in the direction measured is given as the extended fabric length divided by 27.5, converted to a percentage.

In the Tables, "Comp." indicates a Comparison Example, "B.O.S." means boil-off shrinkage, "Ne" means cotton count (English), "nm" indicates "not measured,", "CV" means the coefficient of variation of mass as measured by the Uster Uniformity 1-B tester, "T10" refers to the tenacity of the bicomponent fiber at 10% elongation, "let-down ratio" means the ratio of puller roll speed to last draw roll speed, and "bico." means bicomponent. "Thicks" refers to the number of places per 1000 yards of yarn having a mass at least 50% greater than the average mass; "thins" refers to the number of places per 1000 yards of yarn having a mass at least 50% lower than the average mass. "Neps" refers to the number of places per 1000 yards of yarn having a mass at least 200% more than the average mass. The number of thicks, thins, and neps reported is as measured by the Uster Uniformity 1-B tester. "filling" refers to weft yarn.

EXAMPLES

The following Examples demonstrate the present invention and its capability for use. The invention is capable of other and different embodiments, and its several details are capable of modifications in various apparent respects, without departing from the scope and spirit of the present invention. Accordingly, the Examples are to be regarded as illustrative in nature and not as restrictive.

The monocomponent poly(ethylene terephthalate) staple fiber used in some of the Comparison Examples was T-729W, which is commercially available from Invista S. à r. I. This fiber has a tetrachannel scalloped oval cross-section with a semi-dull luster, 1.4 denier per filament (dpf), and a cut length of 1.5 inches (3.8 cm). The aspect ratio of the cross-section is believed to be 2.0.

Table 1 contains scalloped oval bicomponent fiber preparation conditions not described in the text. Table 2 contains scalloped oval bicomponent fiber properties not described in the text.

Example 1

Continuous bicomponent filaments of poly(ethylene terephthalate) (T211 from Intercontinental Polymers, Inc., 0.56 dl/g IV), and Sorona® brand poly(trimethylene terephthalate) (Sorona® is a registered trademark of E.I. DuPont de Nemours and Company) having an IV of 0.94 dl/g, were extruded in a 50/50 weight ratio from a block operated at 272° C. via metering pumps to a bicomponent spin pack provided with etched metering plates which joined the polymer streams directly above the counterbore of the spinneret capillaries. A delusterant of particulate $TiO_2$ was added to both polymers at a level of 0.1-0.4% by weight. The polymers were spun from a 288-hole spinneret in which the capillaries were 0.38 mm in depth and had a cross-section that was a 0.58 mm long slot with outward triangular bulges in the middle of each long side (maximum width 0.14 mm) and on the ends (maximum width 0.11 mm). The polymer interface was substantially perpendicular to the major axis of the resulting scalloped oval cross-section fiber.

The just-spun fibers were cooled with a cross-flow of air applied at a mass ratio (air/polymer) of about 10-14, spin finish was applied with a metered contact applicator at 0.1 wt %, and the tetrachannel scalloped oval fibers were wound up on bobbins at 1000 m/min. The aspect ratio of the fibers was measured to be about 2.57 (see FIG. 1). The groove ratio was measured to be about 1.3:1.

Fibers from a plurality of bobbins were combined into a tow of approximately 50,000 dtex and drawn in two stages using first and second draw ratios of 2.69 and 1.28, respectively, with a final speed of 50 m/min. The first draw was performed at 35° C. in a water bath, and the second draw, under a hot-water spray at 90° C. The drawn tow was heat-treated at 150° C., cooled to below 30° C. with a dilute finish oil/water spray (0.20 wt % on fiber), and passed to a puller roll operated at a slower speed than the last draw roll. The tow was dried at room temperature and cut to 1.5 inches (3.8 cm) staple length.

Example 2

Polyester bicomponent staple fiber was made as described in Example 1 with the following differences. The polymers were spun from a spinneret as shown in FIG. 6 and having the following dimensions: 1.34 mm long by 0.45 mm wide at the central peak, and 0.34 mm wide at the ends. The poly(ethylene terephthalate) IV was 0.56, and the poly(trimethylene terephthalate) IV was 0.98. Draw ratios were 2.71 and 1.28, respectively. The fiber cross-section was an octachannel scalloped oval with a measured aspect ratio of about 1.97. The groove ratio was measured to be about 1.2:1.

Example 3

Polyester bicomponent staple fiber was made as described in Example 1, with the following differences. Bichannel scalloped oval fibers were extruded in a 60/40 weight ratio of poly(ethylene terephthalate)/poly(trimethylene terephthalate) from a 288 hole spinneret in which the capillaries were 0.25 mm in depth and had cross-sections that were 0.36 mm long slots with rounded ends of 0.18 mm diameter. The poly (ethylene terephthalate) IV was 0.56, the poly(trimethylene terephthalate) IV was 0.98, and the first draw ratio was 2.75. The fibers had a measured aspect ratio of about 2.2 and a measured groove ratio of about 1.8:1 based on the smaller outer bulge.

Comparison Example 1

Polyester bicomponent staple fiber was made as described in Example 1, with the following differences. Scalloped oval fibers (see FIG. 2) with the polymer interface parallel to the major axis of the cross-section were spun through orifices of configuration essentially as shown in FIG. 5. The orifices were arranged to give the desired interface orientation. The poly(trimethylene terephthalate) IV was 0.98, the first draw ratio was 2.71, and let-down ratio was 0.85. The aspect ratio of the fibers was measured to be about 2.2 and the groove ratio was measured to be about 1.3:1.

TABLE 1

| Example | Note on Cross-Section | Capillary Throughput (g/min) | Total Draw Ratio | Let-down Ratio |
|---|---|---|---|---|
| 1 | tetrachannel[1] | 0.33 | 3.37 | 0.98 |
| 2 | octachannel[1] | 0.50 | 3.47 | 0.860 |
| 3 | bichannel[1] | 0.50 | 3.52 | 0.942 |
| Comp. Ex. 1 | tetrachannel[2] | 0.50 | 3.47 | 0.850 |

Notes:
[1]polymer interface substantially perpendicular to major axis of cross-section
[2]polymer interface substantially parallel to major axis of cross-section

TABLE 2

| Example | CI, % | CD, % | Tenacity, cN/dtex | T10, cN/dtex | Linear Density, dtex | Elongation at Break, % | Cardability |
|---|---|---|---|---|---|---|---|
| 1 | 17 | 37 | 3.27 | 1.85 | 1.58 | 30 | good |
| 2 | 22 | 43 | 4.23 | 1.08 | 1.84 | 48 | good |
| 3 | 21 | 45 | 3.75 | 1.28 | 1.76 | 35 | good |
| Comp. Ex. 1 | 22.0 | 55 | 4.24 | 0.95 | 1.83 | 41.0 | poor |

The data in Table 2 show that the scalloped oval fibers having the polymer interface perpendicular to the cross-section major axis display good cardability. This is in contrast to the Comparison scalloped oval fibers not of the invention, which have the polymer interface parallel to the cross-section major axis. The Comparison fibers showed poor cardability.

Spun yarns were prepared that comprised the polyester bicomponent staple fiber samples made in Examples 1-3, Comparative Example 1, or commercially available monocomponent poly(ethylene terephthalate) staple fiber. Unless otherwise noted, the cotton was Standard Strict Low Midland Eastern Variety with an average micronaire of 4.3 (about 1.5 denier per fiber, 91.7 dtex per fiber)). The bicomponent staple was intimately blended to produce the yarns. The cotton and the polyester bicomponent staple fiber were blended by loading both into a dual feed chute feeder, which fed a standard textile card. Unless otherwise, noted, the amount of bicomponent polyester staple in each yarn was 60 wt %, based on the weight of the fiber. The resulting card sliver was 70 grain/yard (about 49,500 dtex). Six ends of sliver were drawn together 6.5× in each of two or three passes (with appropriate recombining of sliver ends before each pass) to give 60 grain/yard (about 42,500 dtex) drawn sliver which was then converted to roving, unless otherwise noted. The total draft in the roving process was 9.9×. Unless otherwise noted, the roving was ring-spun on a Saco-Lowell frame using a back draft of 1.35 and a total draft of 20 to give a 22/1 cotton count (270 dtex) spun yarn having a twist multiplier of 3.8 and 17.8 turns per inch (7.0 turns per centimeter). When 100% cotton was so processed, the resulting spun yarn had a total boil-off shrinkage of 5%. Spun yarn properties are presented in Table 3.

TABLE 3

| Spun Yarn Example (Note) | Polyester Fiber from | CV, % | Thicks | Thins | Neps | Tenacity, cN/tex | B.O.S., % | Yarn Quality Factor |
|---|---|---|---|---|---|---|---|---|
| 4 (1) | Example 1 | 15.57 | 43 | 46 | 8 | 16.49 | 33.5 | 92 |
| 5 (2) | Example 1 | 14.92 | 108 | 15 | 58 | 13.79 | 28 | 196 |
| 6 (2) | Example 2 | 16.5 | 209 | 38 | 100 | 11.3 | 27 | 507 |
| 7 (2) | Example 3 | 17.1 | 304 | 30 | 173 | 12.7 | 26 | 683 |
| Comp. Ex. 2 (2) | Comp. Ex. 1 | 22.07 | 1324 | 516 | 430 | 10.92 | 30 | 4588 |
| Comp. Ex. 3 (3) | T-729W | 9.70 | 1 | 0 | 1 | 29.25 | 3.5 | 0.7 |
| Comp. Ex. 4 (4) | T-729W | 13.18 | 102 | 2 | 73 | 19.36 | 4 | 120 |

Notes:

(1) 100% polyester bicomponent fiber (2) 60 wt % polyester bicomponent fiber, 40 wt % cotton (3) 100% poly(ethylene terephthalate) monocomponent fiber (4) 60 wt % poly(ethylene terephthalate) monocomponent fiber, 40 wt % cotton The data in Table 3 show that the spun yarns comprising the scalloped oval fibers of the invention have good tenacity, and excellent stretch-and-recovery properties as evidenced by the high boil-off shrinkage values. The spun yarns comprising the scalloped oval fibers of the invention also have high uniformity, as seen by the yarn quality factor, the % CV, and the low frequency of thicks, thins, and neps. The spun yarn of Comparison Example 2, which comprises a scalloped oval fiber having the polymer interface parallel to the cross-section major axis, also has tenacity and stretch-and-recovery properties comparable to those of the spun yarns comprising the staple fiber of the invention. However, the yarn quality of Comparison Example 2 is significantly inferior, as evidenced by the higher % CV, the significantly higher frequency of thicks, thins, and neps, and the higher yarn quality factor, as compared to the spun yarns of Examples 4-7. The spun yarns of Comparison Examples 3 and 4, which comprise commercially available scalloped oval monocomponent poly(ethylene terephthalate) staple fiber, are seen to have the best yarn quality and the highest tenacity, but essentially no stretch-and-recovery properties as shown by the very low boil-off shrinkage values.

Woven twill (3×1) and plain weave (1×1) fabrics were made as indicated in Table 4. Circular knit fabrics were made as indicated in Table 5. Woven and knit fabric properties are reported in Tables 6A and 6B, respectively. For each of the fabric samples, spun yarns of the invention or of comparison fibers were used as the weft (fill) or knitting yarn and 100% cotton or blended staple spun yarns were used as warp yarns. The warp yarns were sized before beaming. The sizing was performed on a Suziki single end sizing machine using PVA sizing agent.

Woven fabrics were woven on a Donier air-jet loom with loom speed at 500 picks/minute. Each woven fabric sample was processed by scouring in water at 160° F. (71° C.) for 30 seconds, then at 180° F. (82° C.) for 30 seconds, then at 202° F. (94° C.) for 30 seconds. Next, each fabric was de-sized using a standard enzyme process. The fabrics were then dyed following conventional procedures. The 100% polyester woven fabrics were dyed with a disperse dye at 260° F. (127° C.) for 30 minutes. The woven polyester/cotton fabrics were dyed with a disperse dye, then additionally direct dyed at the boil for 30 minutes using conventional procedures. The fabrics were then after-scoured, treated with a softening and hydrophilic agent, and then air-dried at about 20° C. until dry. Next, the woven fabrics were heat set at 350° F. (177° C.) for 80 seconds. During heat setting, the fabrics were attached to the tenter frame at or slightly under their dyed width.

Knit fabrics were knitted in a single jersey construction. The machine used was 42 feed, 26 inch diameter, with 2232 needles circular knitting machine manufactured by Monarch Knitting Machinery Corporation (Monroe, N.C., USA). When in the greige form, the knit fabrics were slit and laid flat. The full open width of all fabrics at this stage was 68 inches. A set of marks was made on the center of the fabrics separated by 50 cm in both the wale and course direction. All fabrics were first dispersed dyed at 266° F. (130° C.) for 20 minutes following standard dye procedures. Fabrics of Examples 13 and Comparison Example 11 were then additionally direct dyed at 185° F. (85° C.) for 60 minutes. All fabrics were then after-scoured and then rinsed with a hydrophilic softening agent. The fabrics were heat set at 350° F. (177° C.) for 80 seconds by mounting on a tenter frame at a width equal to 4% less than the width of the fabrics measured after dyeing to allow for any additional contraction. The 4% value is for illustrative purposes to maximize the amount of fabric contraction obtained. The distance between these marks was re-measured after the final heat setting process was complete. That number is reported in Table 5 as percent contraction.

TABLE 4

| Woven Fabric Example | Fabric Type | Filling/ Knitting Yarn Example | Fill (ppi) | Fill (cc) | Warp Yarn | Warp (epi) | Width off Loom, (inches) | Width after Heat Set (inches) | Finished Basis Weight (oz/yd$^2$) | Total wt % Cotton in Fabric | Total wt % PET in Fabric | Total wt % poly bico in Fabric |
|---|---|---|---|---|---|---|---|---|---|---|---|---|
| 8 | woven twill | 4 | 38 | 22 | 100% cotton 40/2 | 86 | 76.75 | 57.8 | 6.40 | 71.3 | 0 | 28.7 |
| 9 | plain weave | 4 | 40 | 22 | 65/35 poly/cotton 20/1 | 86 | 77.75 | 61.0 | 6.63 | 24.6 | 45.7 | 29.7 |
| 11 | woven twill | 5 | 38 | 22 | 100% cotton 40/2 | 86 | 77.0 | 59.75 | 6.09 | 82.8 | 0 | 17.2 |
| 12 | plain weave | 5 | 44 | 22 | 65/35 poly/cotton 40/1 | 96 | 77.0 | 60.0 | 4.74 | 37.3 | 35.5 | 27.3 |
| Comp. Ex. 5 | woven twill | Comp. Ex. 2 | 48 | 22 | 100% cotton 40/1 | 96 | 69.0 | 52.6 | 4.90 | 71.4 | 0 | 28.6 |
| Comp. Ex. 6 | twill weave | Comp. Ex. 3 | 38 | 22 | 100% cotton 40/2 | 86 | 77.75 | 69.5 | 5.25 | 71.3 | 28.7 | 0 |
| Comp. Ex. 7 | plain weave | Comp. Ex. 3 | 40 | 22 | 65/35 poly/cotton 20/1 | 6 | 78.25 | 61.0 | 5.84 | 24.6 | 75.4 | 0 |
| Comp. Ex. 9 | twill weave | Comp. Ex. 4 | 38 | 22 | 100% cotton 40/2 | 86 | 77.75 | 69.5 | 5.26 | 82.8 | 17.2 | 0 |
| Comp. Ex. 10 | plain weave | Comp. Ex. 4 | 44 | 22 | 65/35 poly/cotton 40/1 | 96 | 77.0 | 71.0 | 4.26 | 37.3 | 62.7 | 0 |

Notes:
"ppi" means picks-per-inch
"epi" means ends-per-inch

TABLE 5

| Knit Fabric Example | Knitting Yarn Example | Wales per inch, in finished fabric | Courses per inch, in finished fabric | % contraction in course direction | % contraction in wale direction | Width after Heat Set (inches) | Finished Basis Weight (oz/yd$^2$) | Total wt % Cotton in Fabric | Total wt % PET in Fabric | Total wt % poly bico in Fabric |
|---|---|---|---|---|---|---|---|---|---|---|
| 10 | 4 | 36 | 56 | 8 | 37 | 62 | 7.93 | 0 | 0 | 100 |
| 13 | 5 | 35 | 53 | 7 | 33 | 62.5 | 7.49 | 40 | 0 | 60 |
| Comp. Ex. 8 | Comp. Ex. 3 | 35 | 42 | 6 | 17 | 63 | 6.57 | 0 | 100 | 0 |
| Comp. Ex. 11 | Comp. Ex. 4 | 36 | 45 | 7 | 17 | 62.5 | 6.25 | 40 | 60 | 0 |

TABLE 6A

| Woven Fabric Example | Stretch, % | Growth, % | % dry at 14 minutes | % dry at 18 minutes |
|---|---|---|---|---|
| 8 | 17.4 | 1.2 | 62 | 78 |
| 9 | 12.4 | 1.0 | 70 | 85 |
| 11 | 14.9 | 2.0 | 62 | 77 |
| 12 | 16.1 | 1.8 | 74 | 91 |
| Comp. Ex. 5 | 22.3 | 3.8 | 47 | 61 |
| Comp. Ex. 6 | 3.8 | 0.0 | 88 | 98 |
| Comp. Ex. 7 | 4.0 | 0.4 | 78 | 92 |
| Comp. Ex. 9 | 4.8 | 1.0 | 75 | 89 |
| Comp. Ex. 10 | 3.2 | 0.6 | 84 | 100 |

Notes:
Percent stretch and growth values are for the weft direction.

TABLE 6B

| Knit Fabric Example | % Stretch in Course Direction | % Stretch in Wale Direction | % dry at 14 minutes | % dry at 18 minutes |
|---|---|---|---|---|
| 10 | 101.8 | 54.4 | 80 | 96 |
| 13 | 114.2 | 73.8 | 62 | 77 |
| Comp. Ex. 8 | 100.0 | 36.7 | 86 | 99 |
| Comp. Ex | 110.9 | 39.6 | 70 | 84 |

Notes:
"Course" is defined as the row of loops or stitches running across a knit fabric, corresponding to the filling (weft) in woven fabrics. "Wale" in knit fabrics is defined as a column of loops lying lengthwise in the fabric.

The data in Table 6A show that woven fabric Examples 8, 9, 11, and 12 have desirable percent stretch values and desirable low percent growth. As growth is a measure of how much stretch is unrecoverable, low growth is important for woven garment stability during normal wash and wear cycles. In addition, these fabrics show wicking sufficient for them to be at least 62 percent dry at 14 minutes by the percent dry time test.

The data in Table 6B show that, for the circular knit fabrics, the stretch in the course direction is very similar for all of them, reflecting the knit construction. Stretch in the wale direction for fabric Examples 10 and 13, which were circular knits comprising 100% of the scalloped oval fiber of the invention and 100% of a 60/40 blend of scalloped oval fiber of the invention and cotton, respectively, is considerably higher (54% and 73.8%, respectively) than for fabric Comparison Examples 8 and 11 which were circular knits comprising 100% of monocomponent poly(ethylene terephthalate) and 100% of a 60/40 blend of monocomponent poly(ethylene terephthalate) and cotton, respectively. The higher percent stretch results in the wale direction for the fabrics comprising the fiber of the invention agree with the percent contraction results in Table 5. The data show all the circular knit fabric samples to have about the same percent contraction in the course direction, and the knits comprising the fiber of the invention to have significantly higher percent contraction in the wale direction (37% and 33%). The higher wale-direction percent stretch and the higher wale-direction percent contraction results for the circular knits comprising the scalloped oval staple fiber of the invention reflect the high stretch-and-recovery properties of the bicomponent staple fiber of the invention. Fabric Examples 10 and 13 also demonstrated wicking sufficient for them to be at least 62 percent dry at 14 minutes by the percent dry time test. Fabric Examples 10 and 13 also demonstrated wicking sufficient for them to be at least 62 percent dry at 14 minutes by the percent dry time test.

Fabric of Comparison Example 5, which comprised the scalloped oval fiber having the polymer interface parallel to the major cross-section axis, was evaluated for wicking by the percent dry time test despite the surface roughness resulting from the poor yarn quality. The initial wicking rate of such fibers is disclosed in U.S. Pat. No. 6,656,586 to be at least 3.5 cm/min as measured on a scoured single jersey circular knit fabric of about 190 grams per square meter (5.60 ounces per square yard) basis weight and comprising solely about 70 denier (78 decitex) fibers of 34 continuous filaments each, using the test method described in the referenced patent. The fabric of Comparison Example 5 demonstrated desirable high percent stretch (22.3%) but undesirably high percent growth (3.8%), as well as relatively low wicking by the percent dry time test (47% dry at 14 minutes, 61% dry at 18 minutes). The fabrics of Comparison Examples 6-11 showed good wicking by the percent dry time method and very low percent growth, but also much less of the desired percent stretch.

Percent dry with time results for circular knit fabric samples are presented in Table 7. Percent dry with time results for woven twill fabric samples are presented in Table 8. Percent dry with time results for plain weave fabric samples are presented in Table 9.

TABLE 7

| | Percent Dry for Fabric Example | | | |
|---|---|---|---|---|
| Time (min) | 10 | 13 | Comp. Ex. 8 | Comp. Ex. 11 |
| 0 | 0 | 0 | 0 | 0 |
| 2 | 13 | 8 | 13 | 10 |
| 4 | 23 | 18 | 26 | 20 |
| 6 | 36 | 27 | 40 | 30 |
| 8 | 47 | 36 | 52 | 40 |
| 10 | 58 | 46 | 65 | 50 |
| 12 | 70 | 53 | 75 | 59 |
| 14 | 80 | 62 | 86 | 70 |
| 16 | 89 | 69 | 95 | 76 |
| 18 | 96 | 77 | 99 | 84 |
| 20 | 100 | 84 | 100 | 90 |
| 22 | 100 | 88 | 100 | 95 |
| 24 | 100 | 94 | 100 | 97 |
| 26 | 100 | 96 | 100 | 99 |
| 28 | 100 | 99 | 100 | 100 |
| 30 | 100 | 100 | 100 | 100 |

TABLE 8

| Time | Percent Dry for Fabric Example | | | | |
|---|---|---|---|---|---|
| (min) | 8 | 11 | Comp. Ex. 5 | Comp. Ex. 6 | Comp. Ex. 9 |
| 0 | 0 | 0 | 0 | 0 | 0 |
| 2 | 9 | 9 | 8 | 16 | 13 |
| 4 | 17 | 17 | 14 | 32 | 25 |
| 6 | 27 | 27 | 23 | 45 | 36 |
| 8 | 37 | 36 | 28 | 59 | 48 |
| 10 | 45 | 44 | 33 | 71 | 56 |
| 12 | 53 | 54 | 42 | 82 | 68 |
| 14 | 62 | 62 | 47 | 88 | 75 |
| 16 | 70 | 69 | 55 | 94 | 83 |
| 18 | 78 | 77 | 61 | 98 | 89 |
| 20 | 85 | 82 | 66 | 100 | 93 |

TABLE 8-continued

| Time | Percent Dry for Fabric Example | | | | |
|---|---|---|---|---|---|
| (min) | 8 | 11 | Comp. Ex. 5 | Comp. Ex. 6 | Comp. Ex. 9 |
| 22 | 90 | 88 | 72 | 100 | 98 |
| 24 | 95 | 92 | 79 | 100 | 100 |
| 26 | 97 | 96 | 82 | 100 | 100 |
| 28 | 100 | 97 | 88 | 100 | 100 |
| 30 | 100 | 100 | 91 | 100 | 100 |

TABLE 9

| | Percent Dry for Fabric Example | | | |
|---|---|---|---|---|
| Time (min) | 9 | 12 | Comp. Ex. 7 | Comp. Ex. 10 |
| 0 | 0 | 0 | 0 | 0 |
| 2 | 10 | 14 | 11 | 14 |
| 4 | 21 | 22 | 24 | 28 |
| 6 | 32 | 34 | 35 | 40 |
| 8 | 41 | 45 | 47 | 52 |
| 10 | 51 | 55 | 60 | 64 |
| 12 | 61 | 65 | 70 | 77 |
| 14 | 70 | 74 | 78 | 84 |
| 16 | 78 | 83 | 86 | 92 |
| 18 | 85 | 91 | 92 | 100 |
| 20 | 93 | 96 | 96 | 100 |
| 22 | 96 | 98 | 98 | 100 |
| 24 | 97 | 100 | 100 | 100 |
| 26 | 100 | 100 | 100 | 100 |
| 28 | 100 | 100 | 100 | 100 |
| 30 | 100 | 100 | 100 | 100 |

Data in Table 7 show percent dry with time results for circular knit fabric samples. The fabric samples which comprised a polyester bicomponent/cotton or monocomponent poly(ethylene terephthalate)/cotton blend (Example 13 and Comparison Example 11, respectively) showed lower percent dry results at a given time, indicating poorer wicking characteristics than did the fabric comprising 100% of the tetrachannel scalloped oval polyester bicomponent fiber (Example 10) or the fabric comprising 100% of the monocomponent poly (ethylene terephthalate) fiber. Circular knit fabric Example 10, having a finished basis weight of 7.93 ounces per square yard and comprising a spun yarn comprising 100 weight percent of the scalloped oval bicomponent polyester fiber, demonstrated wicking sufficient for the fabric to be about 80 percent dry at 14 minutes. The fabric was about 96 percent dry at 18 minutes. Fabric Example 13, which had a finished basis weight of 7.49 ounces per square yard and comprised a spun yarn comprising 60 weight percent scalloped oval bicomponent polyester fiber and 40 weight percent cotton, demonstrated wicking sufficient for the fabric to be about 62 percent dry at 14 minutes. The fabric was about 77 percent dry at 18 minutes.

Data in Table 8 show percent dry with time results for woven twill fabric samples. Fabric samples 8 and 11, which comprised 28.7 and 17.2 weight percent tetrachannel scalloped oval polyester bicomponent fiber, respectively, with the balance being cotton, showed wicking sufficient for the fabrics to be about 62 percent dry at 14 minutes. The fabrics were about 78 and about 77 percent dry at 18 minutes, respectively. The finished basis weights of the fabrics were 6.40 and 6.09 ounces per square yard, respectively.

Data in Table 9 show percent dry with time results for plain weave fabric samples, all of which contain cotton and monocomponent poly(ethylene terephthalate). Fabric Examples 9 and 12 also comprised tetrachannel scalloped oval polyester bicomponent fiber. Fabric samples 9 and 12 displayed wicking sufficient for the fabrics to be about 70 and about 74 percent dry, respectively, at 14 minutes. The fabrics were about 85 and about 91 percent dry, respectively, at 18 minutes. Finished basis weight was 6.63 ounces per square yard for Example 9 and 4.74 ounces per square yard for Example 12.

The data in Tables 2-9 show that the scalloped oval polyester bicomponent fibers of the invention possess a combination of stretch and recovery, good wicking, and good carding properties which can give spun yarns having high boil-off shrinkage (and therefore high stretch-and-recovery properties) and high uniformity, as well as fabrics with good stretch and recovery, low percent growth, and good wicking properties.

For comparison purposes, percent dry with time results for 100% cotton and water only are presented in Table 10.

TABLE 10

| Time (min) | Percent Dry for 100% Cotton Circular Knit | Percent Dry for Water Only (no fabric) |
|---|---|---|
| 0 | 0 | 0 |
| 2 | 5 | 1 |
| 4 | 11 | 3 |
| 6 | 16 | 5 |
| 8 | 21 | 7 |
| 10 | 26 | 9 |
| 12 | 32 | 11 |
| 14 | 37 | 13 |
| 16 | 43 | 15 |
| 18 | 48 | 17 |
| 20 | 54 | 19 |
| 22 | 59 | 21 |
| 24 | 63 | 23 |
| 26 | 69 | 25 |
| 28 | 72 | 26 |
| 30 | 77 | 29 |

Data in Table 10 show wicking results for a 100% cotton circular knit fabric and for water evaporating out of contact with any fabric. For the 100% cotton circular knit fabric, percent dry results with time are significantly lower than those reported in the above Tables for cotton/polyester blends or 100% polyester fabrics. For the water only case, the percent dry results with time refer to the amount of water that evaporated and show that the water evaporation rate was significantly slower without the benefit of wicking by a fabric.

Many modifications and other embodiments of the inventions set forth herein will come to one skilled in the art to which these inventions pertain having the benefit of the teachings presented in the foregoing descriptions and the associated figures. Therefore, it is to be understood that the inventions are not to be limited to the specific embodiments disclosed and that modifications and other embodiments are intended to be included within the scope of the appended claims.

What is claimed is:

1. A polyester bicomponent staple fiber comprising poly (trimethylene terephthalate) and at least one polymer selected from the group consisting of poly(ethylene terephthalate), poly(trimethylene terephthalate), and poly(tetramethylene terephthalate) or a combination of such members, said bicomponent staple fiber having:

a) a scalloped oval cross-section shape having an aspect ratio a:b of about 2:1 to about 5:1 wherein 'a' is a fiber cross-section major axis length and 'b' is a fiber cross-section minor axis length:

b) a polymer interface substantially perpendicular to the major axis;

c) side-by-side cross-section configuration;

d) a plurality of longitudinal grooves selected from the group consisting of four grooves, six grooves and eight grooves; and e) a groove ratio of about 1.05:1 to about 1.9:1.

2. The staple fiber of claim 1, wherein the aspect ratio a:b is about 2.2:1 to about 3.5:1 and the groove ratio is about 1.1:1 to about 1.5:1.

3. The staple fiber of claim 1 having a tenacity at 10% elongation of about 1.0 cN/dtex to about 3.5 cN/dtex.

4. The staple fiber of claim 1 having a tow crimp development value of about 25% to about 55% and a tow crimp index value of about 10% to about 25%.

5. The staple fiber of claim 1 having a weight ratio of at least about 30:70 and no more than about 70:30 of poly (trimethylene terephthalate) to the at least one polymer selected from the group consisting of polyethylene terephthalate), poly(trimethylene terephthalate), and poly(tetramethylene terephthalate) or a combination of such members.

6. The staple fiber of claim 1, wherein the fiber has a tetrachannel cross-section shape.

7. The staple fiber of claim 1, wherein the fiber comprises poly(ethylene terephthalate) and poly(trimethylene terephthalate).

8. The staple fiber of claim 1, wherein the fiber comprises poly(trimethylene terephthalate) and poly(trimethylene terephthalate).

9. A polyester bicomponent staple fiber comprising poly (ethylene terephthalate) and poly(trimethylene terephthalate), said bicomponent staple fiber having:

a) a scalloped oval cross-section shape having an aspect ratio a:b of about 2.2:1 to about 3.5:1 wherein 'a' is a fiber cross-section major axis length and 'b' is a fiber cross-section minor axis length;

b) a polymer interface substantially perpendicular to the major axis;

c) a side-by-side cross-section configuration;

d) a plurality of longitudinal grooves selected from the group consisting of four grooves, six grooves and eight grooves;

e) a groove ratio of about 1.1:1 to about 1.5:1; and f) a tenacity at 10% elongation of about 1.0 cN/dtex to about 3.5 cN/dtex.

10. A spun yarn comprising cotton and the polyester bicomponent staple fiber of claim 1, wherein the spun yarn has a cotton count of about 14 to about 60 and a quality factor of about 0.1 to about 500.

11. The spun yarn of claim 10, wherein the spun yarn has a total boil-off shrinkage from about 20% to about 45%.

12. The spun yarn of claim 10 having a coefficient of variation of mass from about 13% to about 20%.

13. The spun yarn of claim 10, wherein the bicomponent staple fiber has a tetrachannel cross-section shape.

14. The spun yarn of claim 10, wherein the bicomponent staple fiber is present at a level of about 30 weight percent to about 100 weight percent, based on total weight of the spun yarn.

15. The spun yarn of claim 10, further comprising about 30 weight percent to about 69 weight percent polyethylene terephthalate) monocomponent staple fiber.

16. The spun yarn of claim 10, wherein the bicomponent staple fiber comprises poly(ethylene terephthalate) and poly (trimethylene terephthalate).

17. The spun yarn of claim 10, wherein the bicomponent staple fiber comprises poly(trimethylene terephthalate) and poly(trimethylene terephthalate).

18. A spun yarn comprising cotton and the polyester bicomponent staple fiber of claim 9, wherein the spun yarn has a cotton count of about 14 to about 60 and a quality factor of about 0.1 to about 500.

19. A fabric comprising the spun yarn of claim 10.

20. A fabric comprising the spun yarn of claim 14.

21. A fabric comprising the spun yarn of claim 15.

22. A fabric comprising the spun yarn of claim 16.

23. A fabric comprising the spun yarn of claim 18.

24. A fabric comprising the staple fiber of claim 1 and having wicking sufficient for the fabric to be at least 60 percent dry at 14 minutes by the percent dry time test, wherein the fabric has a finished basis weight of about 102 grams per square meter to about 288 grams per square meter.

25. The fabric of claim 24, wherein the finished basis weight is about 203 grams per square meter to about 271 grams per square meter.

26. A fabric comprising the staple fiber of claim 9 and having wicking sufficient for the fabric to be at least 80 percent dry at 14 minutes by the percent dry time test, wherein the fabric has a finished basis weight of about 102 grams per square meter to about 288 grams per square meter.

27. The fabric of claim 26, wherein the finished basis weight is about 203 per square meter to about 271 grams per square meter.

28. A polyester bicomponent staple fiber mixture comprising a first staple fiber and a second staple fiber, said first and said second staple fiber each comprising poly(trimethylene terephthalate) and at least one polymer selected from the group consisting of poly(ethylene terephthalate), poly(trimethylene terephthalate), and poly(tetramethylene terephthalate) or a combination of such members, said first bicomponent staple fiber having a) a scalloped oval cross-section shape having an aspect ratio a:b of about 2:1 to about 5:1 wherein 'a' is a fiber cross-section major axis length and 'b' is a fiber cross-section minor axis length;

b) a polymer interface substantially perpendicular to the major axis;

c) a side-by-side cross-section configuration;

d) a plurality of longitudinal grooves selected from the group consisting of four grooves, six grooves and eight grooves; and e) a groove ratio of about 1.05:1 to about 1.9:1;

said second staple fiber having a) a cross-section configuration selected from the group consisting of side-by-side and eccentric sheath-core, and b) a cross-section shape selected from the group consisting of substantially oval and scalloped oval; and wherein the polyester bicomponent staple fiber mixture optionally further comprises at least one polyester bicomponent staple fiber.

29. A spun yarn comprising cotton and the polyester bicomponent staple fiber mixture of claim 28, wherein the spun yarn has a cotton count of about 14 to about 60 and a quality factor of about 0.1 to about 500.

30. The spun yarn of claim 29 having a total boil-off shrinkage from about 20% to about 45%.

31. The spun yarn of claim 29 having a coefficient of variation of mass from about 13% to about 20%.

32. The spun yarn of claim 29, wherein the bicomponent staple fiber mixture is present at a level of about 3D weight percent to about 100 weight percent, based on total weight of the spun yarn.

33. The spun yarn of claim 29, further comprising about 30 weight percent to about 69 weight percent poly(ethylene terephthalate)monocomponent staple fiber.

34. The spun yarn of claim 29, wherein the bicomponent staple fiber mixture comprises poly(ethylene terephthalate) and poly(trimethylene terephthalate).

35. A fabric comprising the spun yarn of claim 29.

36. A fabric comprising the spun yarn of claim 32.

37. A fabric comprising the spun yarn of claim 33.

38. A fabric comprising the spun yarn of claim 34.

39. A fabric comprising the staple fiber mixture of claim 29 and having wicking sufficient for the fabric to be at least 60 percent dry at 14 minutes by the percent dry time test, wherein the fabric has a finished basis weight of about 102 grams per square meter to about 288 grams per square meter.

40. The fabric of claim 39, wherein the finished basis weight is about 203 grams per square meter to about 271 grams per square meter.

41. A garment comprising the fabric of claim 19 or 23 or 24 or 26.

42. A garment comprising the fabric of claim 35 or 36 or 39.

43. A nonwoven fabric comprising the staple fiber of claim 1.

* * * * *